US006349915B1

(12) United States Patent
Jones et al.

(10) Patent No.: US 6,349,915 B1
(45) Date of Patent: Feb. 26, 2002

(54) DOCUMENT SUPPORT

(75) Inventors: David K. Jones, Grand Rapids; Joseph D. Ruedinger, Grand Haven, both of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/563,093

(22) Filed: May 2, 2000

(51) Int. Cl.[7] ..... B41J 11/02
(52) U.S. Cl. ..... 248/442.2
(58) Field of Search ..... 248/442.2, 918, 248/451, 453; 40/341

(56) References Cited

U.S. PATENT DOCUMENTS

| | | | |
|---|---|---|---|
| 363,142 | A | 5/1887 | Horton |
| 560,465 | A | 5/1896 | Bostwick |
| D33,849 | S | 1/1901 | Meyer |
| 1,006,334 | A | 10/1911 | Wright |
| 1,681,586 | A | 8/1928 | Kessler |
| 1,704,561 | A | 3/1929 | Egan |
| 1,719,503 | A | 7/1929 | Egan |
| 1,841,690 | A | 1/1932 | Weindel, Jr. |
| 2,117,668 | A | 5/1938 | Johnson |
| D183,947 | S | 11/1958 | Quistgaard |
| 3,073,056 | A | 1/1963 | Russell |
| 3,272,183 | A | 9/1966 | Craighead et al. |
| 3,361,131 | A | 1/1968 | Barger |
| 3,779,504 | A | 12/1973 | Schwartz et al. |
| D246,062 | S | 10/1977 | Kowalski |
| 4,125,243 | A | 11/1978 | Liptak |
| 4,204,598 | A | 5/1980 | Adams |
| D271,895 | S | 12/1983 | Runions |
| D272,547 | S | 2/1984 | Gordon |
| D273,961 | S | 5/1984 | Bassey |
| D274,919 | S | 7/1984 | Basaldua, Jr. |
| 4,475,705 | A | 10/1984 | Henneberg et al. |
| 4,494,755 | A | 1/1985 | Caillouet, Jr. |
| 4,546,947 | A | 10/1985 | Gesten |
| D281,384 | S | 11/1985 | Lacey |
| 4,635,893 | A | 1/1987 | Nelson |
| 4,645,163 | A | 2/1987 | Zovar |
| 4,685,647 | A | 8/1987 | Calhoun |
| D294,209 | S | 2/1988 | Havelka |
| 4,836,489 | A | 6/1989 | Chu |
| 4,840,361 | A | 6/1989 | Richter |
| D303,126 | S | 8/1989 | Rossow |
| 4,863,124 | A | 9/1989 | Ball et al. |
| 4,893,775 | A | 1/1990 | Long |
| D306,529 | S | 3/1990 | Goodell |
| D314,565 | S | 2/1991 | Davis et al. |
| D314,566 | S | 2/1991 | Davis et al. |
| D316,115 | S | 4/1991 | Davis et al. |
| D320,198 | S | 9/1991 | Ward |
| 5,067,681 | A | 11/1991 | Huang et al. |
| 5,074,511 | A | 12/1991 | Wilson |

(List continued on next page.)

*Primary Examiner*—Ramon O. Ramirez
(74) *Attorney, Agent, or Firm*—Price, Heneveld, Cooper, DeWitt & Litton

(57) ABSTRACT

A combination keyboard support tray and removable document support for use in offices and other similar environments. A keyboard support tray has a base adapted to secure the keyboard support tray to a worksurface. The keyboard support tray has an upper surface adapted to support a keyboard and defining a perimeter having a front edge adapted to be positioned adjacent a user and a rear edge adapted to be positioned away from a user. A document support has at least one clip removably securing the document support to the perimeter of the keyboard support tray. A document support includes upwardly-opening document support groove having a curved shape in plan view to retain a document in an upwardly-extended configuration wherein the document can be readily viewed by a user of the keyboard support tray.

20 Claims, 4 Drawing Sheets

U.S. PATENT DOCUMENTS

| | | | | |
|---|---|---|---|---|
| 5,104,086 | A | | 4/1992 | Ramey, III et al. |
| D328,923 | S | | 8/1992 | Tu |
| 5,136,787 | A | | 8/1992 | Phills |
| 5,144,303 | A | | 9/1992 | Purcell |
| 5,144,763 | A | | 9/1992 | Calhoun |
| 5,161,767 | A | | 11/1992 | Hansen |
| D333,723 | S | | 3/1993 | Risner |
| D333,819 | S | | 3/1993 | Toney |
| 5,264,995 | A | | 11/1993 | McKee |
| 5,292,099 | A | | 3/1994 | Isham et al. |
| 5,301,915 | A | | 4/1994 | Bahniuk et al. |
| D348,374 | S | | 7/1994 | Dandurand |
| 5,328,145 | A | | 7/1994 | Charapich |
| 5,341,929 | A | | 8/1994 | Stefancin, Jr. |
| D350,374 | S | | 9/1994 | Comeau |
| 5,347,738 | A | | 9/1994 | Zweig et al. |
| 5,383,643 | A | | 1/1995 | Koch |
| 5,398,905 | A | | 3/1995 | Hinson |
| D357,008 | S | | 4/1995 | Pohlman |
| D357,705 | S | | 4/1995 | Milojevich |
| D366,064 | S | | 1/1996 | Milojevich |
| D366,675 | S | | 1/1996 | Milojevich |
| 5,497,970 | A | | 3/1996 | Pursell, Jr. |
| 5,499,793 | A | | 3/1996 | Salansky |
| 5,505,421 | A | | 4/1996 | Marthaler |
| D369,473 | S | | 5/1996 | Gluck |
| 5,533,702 | A | | 7/1996 | Koch |
| 5,618,020 | A | | 4/1997 | Hegarty et al. |
| D379,374 | S | | 5/1997 | Mason, III |
| 5,636,822 | A | | 6/1997 | Hendershot et al. |
| 5,651,524 | A | | 7/1997 | Calfee |
| D382,017 | S | | 8/1997 | Bohr et al. |
| D383,122 | S | | 9/1997 | Parks |
| 5,678,792 | A | | 10/1997 | Arguin et al. |
| D386,532 | S | | 11/1997 | Bass |
| 5,735,222 | A | | 4/1998 | Webb |
| 5,751,548 | A | * | 5/1998 | Hall et al. ..... 248/124.1 |
| D395,554 | S | | 6/1998 | Perkins, Jr. |
| D396,309 | S | | 7/1998 | Churchville et al. |
| 5,775,663 | A | | 7/1998 | Fitzsimmons et al. |
| 5,786,861 | A | | 7/1998 | Parker |
| 5,806,693 | A | | 9/1998 | Carbonaro |
| 5,857,654 | A | | 1/1999 | Berman |
| 5,890,603 | A | | 4/1999 | Arguin et al. |
| 5,901,937 | A | | 5/1999 | Compeau et al. |

* cited by examiner

DOCUMENT SUPPORT

BACKGROUND OF THE INVENTION

The present invention relates to a document support, and in particular to a document that can be attached to a keyboard support tray without interfering with operation of the keyboard support tray.

Personal computers are becoming more common in many industry and office environments. Such systems may employ a keypad, mouse, and/or other data input devices, such as a digitizing pad. Often, the personal computer occupies much of the desk or worksurface, making it difficult to locate the keyboard thereon. Furthermore, many users do not prefer to locate the keyboard on the desktop because it is uncomfortable to address the keyboard over the course of the workday. A number of devices have been developed to offer greater flexibility in supporting the keyboard, mouse, or other user interface devices at a comfortable position relative to the user. Available keyboard support assemblies include a keyboard support surface that is permanently attached to a height adjustment device. Such height adjustment devices may be capable of positioning the keyboard support surface below the worksurface during use and/or for storage. Various keyboard support configurations have been developed, and may include a hand support, a mouse support, or a specific keyboard clamping arrangement.

During operation of the computer, an operator may need to read a document for entry of the information from the document. Various document holders or "copy stands" have been developed for this purpose. However, such holders are generally designed to be placed on a worksurface adjacent the user. Accordingly, such supports obstruct the worksurface, and also may be difficult to position in a comfortable line of sight for the user.

Accordingly, a device alleviating the above-identified drawbacks of existing devices is desired.

SUMMARY OF THE INVENTION

One aspect of the present invention is to provide a combination keyboard support tray and document support for use in offices and other similar environments. A keyboard support tray has a base adapted to secure the keyboard support tray to a worksurface. The keyboard support tray has an upper surface adapted to support a keyboard and defining a perimeter having a front edge adapted to be positioned adjacent a user and a rear edge adapted to be positioned away from a user. A document support has at least one clip removably securing the document support to the perimeter of the keyboard support tray. A document support includes an upwardly-opening document support groove having a curved shape in plan view to retain a document in an upwardly-extended configuration wherein the document can be readily viewed by a user of the keyboard support tray.

Another aspect of the present invention is a combination keyboard support tray and document support including a keyboard support tray having a rear edge adapted to be positioned away from a user. The keyboard support tray includes a first connector. A document support has an upwardly-opening document support groove having a curved shape in plan view. An edge portion of a document can be placed in the document support groove to support the document in an upwardly-extending configuration. The document support includes a second connector releasably interconnecting the document support to the keyboard support tray and positioning the document support groove adjacent the rear edge of the keyboard support tray such that a document supported in the groove extends upwardly above the keyboard support tray in a readily viewable position.

Yet another aspect of the present invention is a clip-on document support adapted for connection to an edge of a keyboard support tray. The document support includes an attachment structure having a U-shaped portion configured to receive an edge portion of a keyboard support tray. The document support also includes at least one barb adapted to engage a keyboard support tray to retain a document support, and an upwardly-opening document support groove having a curved shape in plan view to support a document in an upwardly-extending position.

These and other advantages of the invention will be further understood and appreciated by those skilled in the art by reference to the following written specification, claims, and appended drawings.

BRIEF DESCRIPTION OF THE DRAWINGS

FIG. 4;

FIG. 4;

DETAILED DESCRIPTION OF PREFERRED EMBODIMENT

Figure 1:
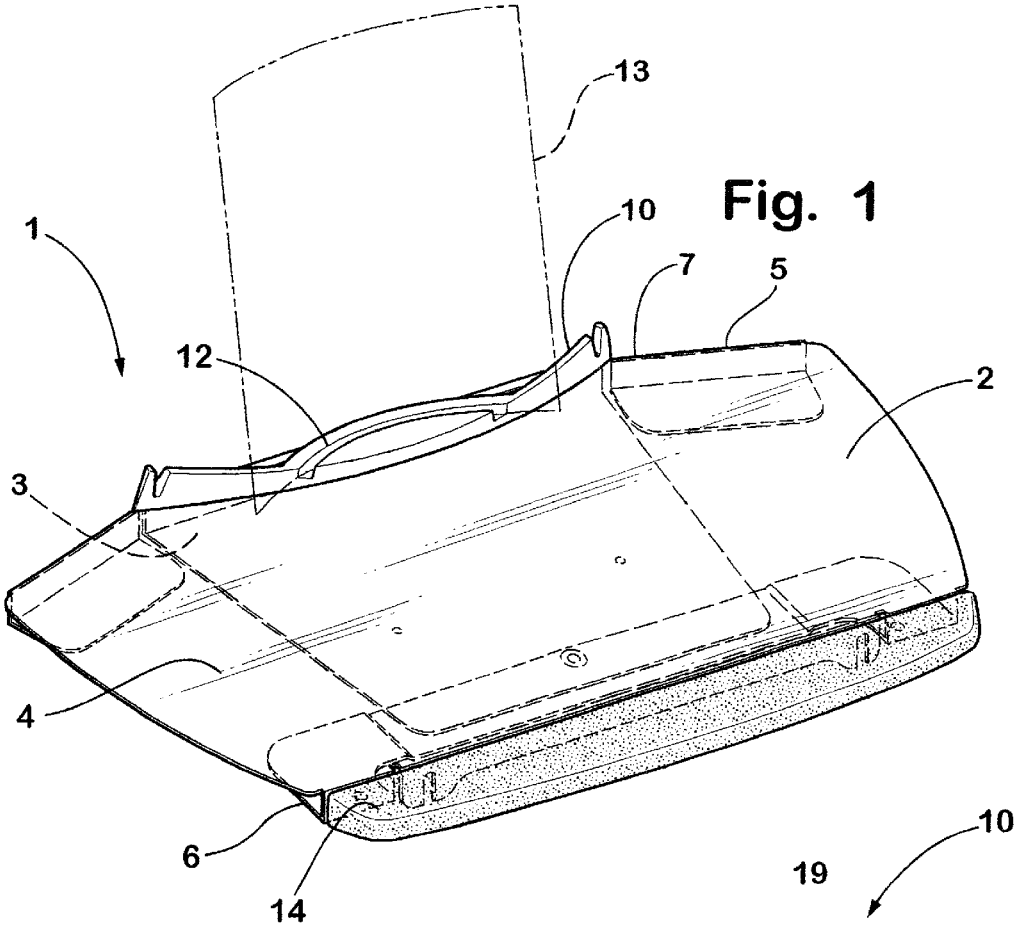
FIG. 1 is a perspective view of a keyboard support tray and removable document support embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a combination keyboard support tray and document support embodying the present invention, which is particularly designed for use in offices and other similar settings and environments. In the illustrated example, the combination keyboard support and document support includes a keyboard tray 2 having a base 3 adapted to secure the keyboard support tray 2 to a worksurface such as a desk (not shown).

Figure 2:
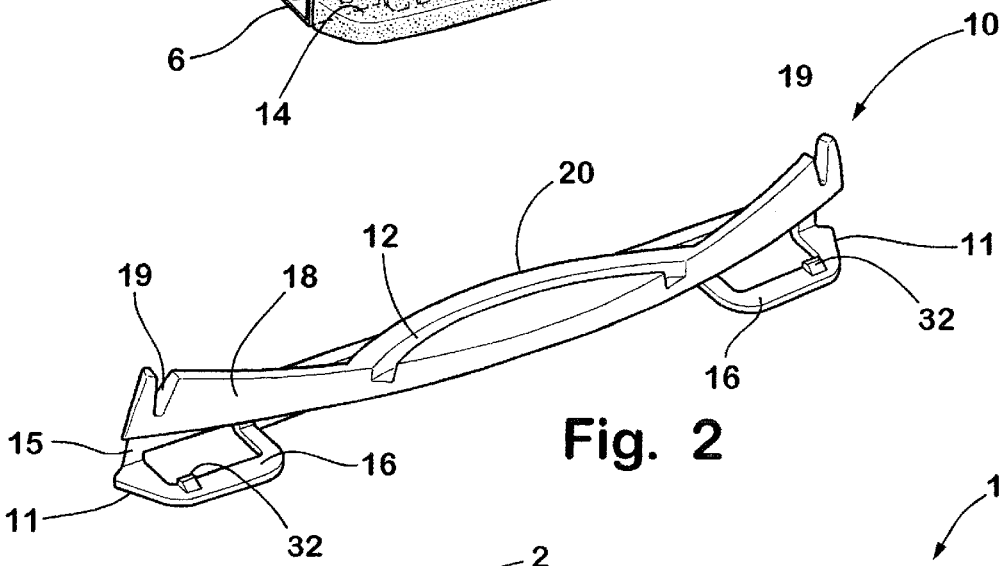
FIG. 2 is a perspective view of the removable document support of FIG. 1.
Figure 4:
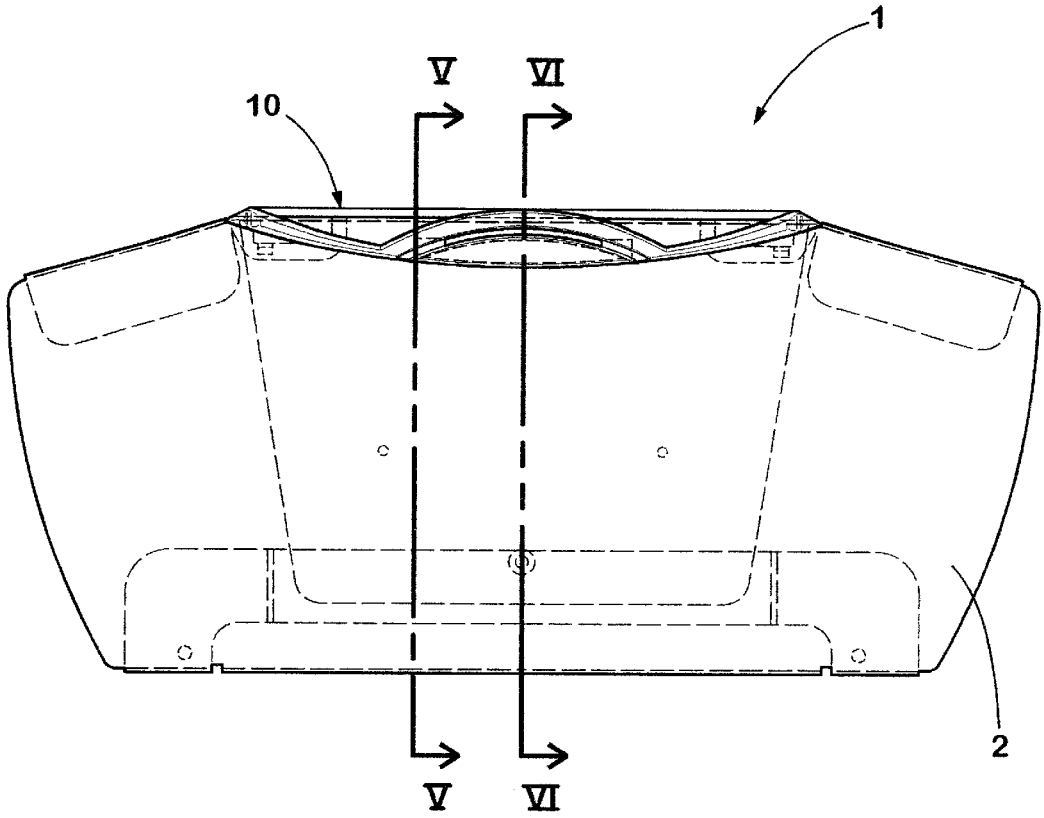
FIG. 4 is a top plan view of the keyboard support tray and removable document support of FIG. 1.

The keyboard support tray 2 has an upper surface 4 adapted to support a computer keyboard (not shown). The upper surface defines a perimeter 5 having a front edge 6 adapted to be positioned adjacent a user, and a rear edge 7 adapted to be positioned away from a user. The document support 10 has at least one clip 11 (FIG. 2) securing the document support 10 to the perimeter 5 of the keyboard support tray 2. The document support 10 includes an upwardly-opening document support groove 12 having a curved shape in plan view (see also FIG. 4) to retain a document 13 in an upwardly-extending configuration wherein the document 13 can be readily viewed by a user of the keyboard support tray 2.

Keyboard support tray 2 is substantially the same as a commercially available details® "CSP" model available from Steelcase Inc., Grand Rapids, Mich. As described in more detail below, keyboard support tray 2 includes openings that receive barbs of document support 10 to retain the document support 10 on tray 2. The illustrated keyboard tray 2 may include a padded, height-adjustable wrist rest 14. The keyboard support tray 2 may be connected to a worksurface by an adjustable height support arm (not shown) such as that disclosed in U.S. Pat. No. 6,135,405, entitled TILT LOCKOUT FOR ARTICULATED KEYBOARD SUPPORTS, filed Jan. 9, 1998, and issued on Oct. 24, 2000 the entire contents of which are hereby incorporated by reference. The "CSP" tray 2 may also be connected to commercially available Steelcase/Details "Stella", "Eastridge", and "Spring Assist" mechanisms. The document support 10 is preferably of a reduced height that is less than the height of a conventional computer keyboard, such that the document support 10 and keyboard support tray 2 may be attached to a conventional articulated arm support mechanism and positioned below the worksurface when not in use. The compact design of the document support 10 permits the keyboard support tray 2 to be positioned directly adjacent the lower surface of a worksurface in a position that is out of the way of the legs of a seated user.

Figure 5:
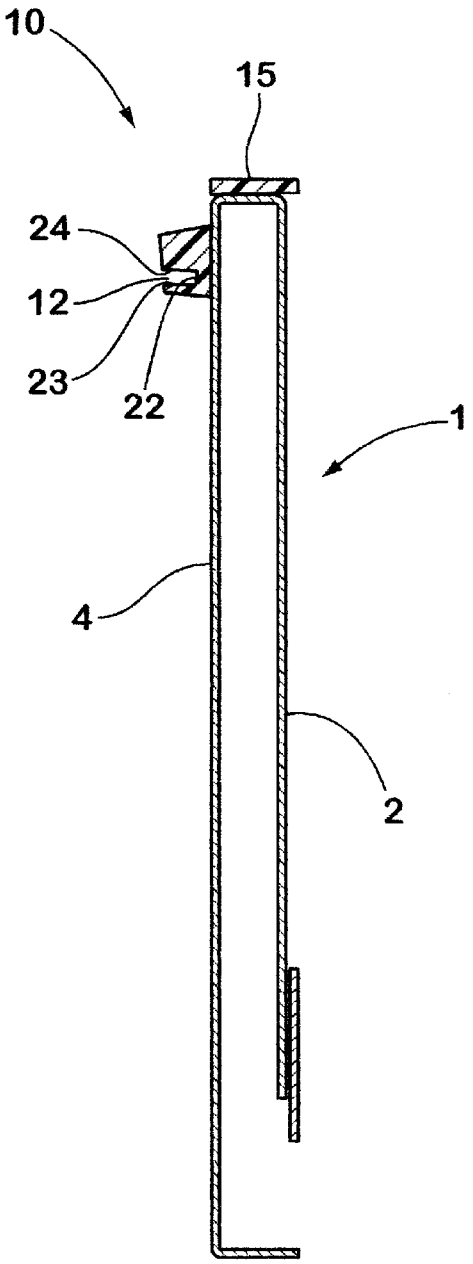
FIG. 5 is a cross-sectional view taken along the line V—V.
Figure 6:
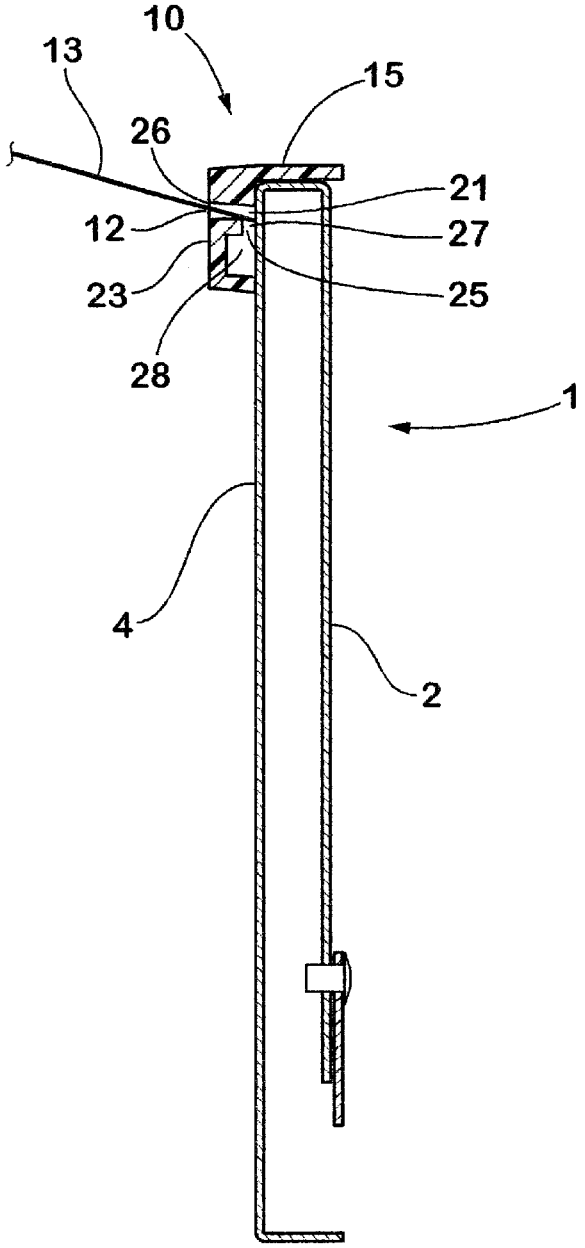
FIG. 6 is a cross-sectional view taken along the line VI—VI.
Figure 7:
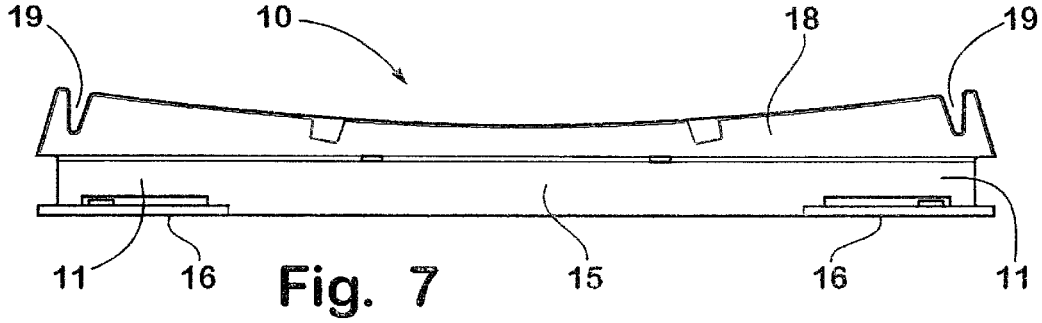
FIG. 7 is a rear elevational view of the removable document support of FIG. 1.
Figure 8:
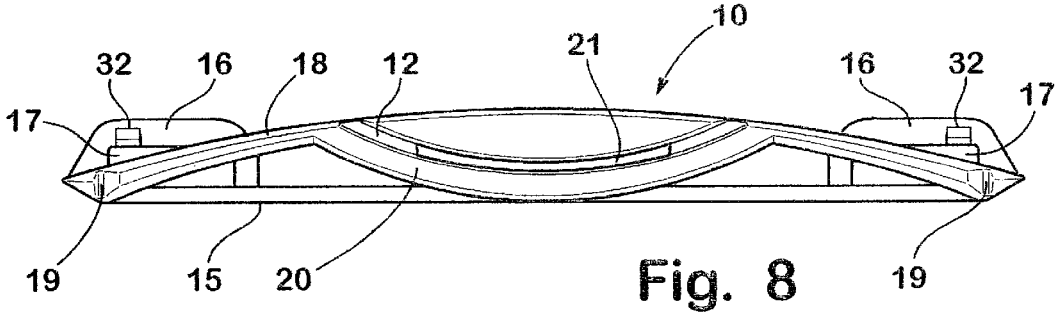
FIG. 8 is a top plan view of the document support of FIG. 1.
Figure 9:
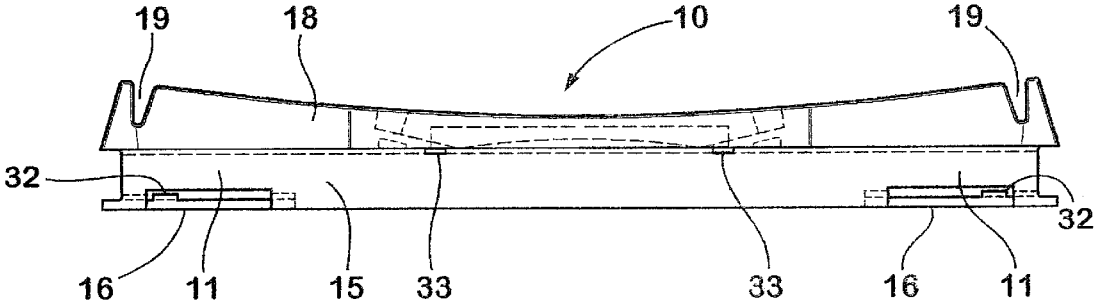
FIG. 9 is a front elevational view of the document support of FIG. 1.

The document support 10 (FIG. 2) is made of a polymer material, and includes a pair of forwardly-opening clips 11 that fit over the rear edge 7 of keyboard support tray 2. Clips 11 are formed by a downwardly-extending web or wall 15, and forwardly-extending lower flanges 16 (FIG. 8), each of which has an opening 17 therethrough. An upwardly-extending wall 18 has an arcuate plan shape (FIG. 8), and includes a pair of V-shaped notches 19 that receive and retain a computer mouse wire or line (not shown). An arcuate structural portion 20 extends from a central portion of the arcuate wall 18. Document support groove 12 is formed in arcuate portion 20, and includes an opening 21 through a central portion of groove 12. Groove 12 has an upwardly-opening U-shaped cross section having a base surface 22 (FIG. 5), and generally parallel front and rear sidewall surfaces 23 and 24, respectively. Opening 21 in base surface 22 receives a lower edge portion 25 (FIG. 6) of document 13, such that document 13 contacts upper corner 26 and lower corner 27 of groove 12, thereby preventing document 13 from pivoting rearwardly away from the user out of engagement with document support groove 12. Front sidewall 23 of document support groove 12 is spaced-apart from upper surface 4 of keyboard support tray 2, thereby forming a gap 28 that receives the lower edge portion 25 of document 13. Gap 28 permits the lower edge of the document 13 to protrude forwardly of lower corner 27 into contact with upper surface 4 of tray 2, thereby preventing rearward tilting and/or rotation of document 13, and subsequent disengagement from document support groove 12. The arcuate plan view shape of groove 12 (FIG. 8) holds the document in a curved shape to provide rigidity, such that the document does not bend or sag downwardly, such that the document is retained in an upwardly-extending configuration.

Figure 3:
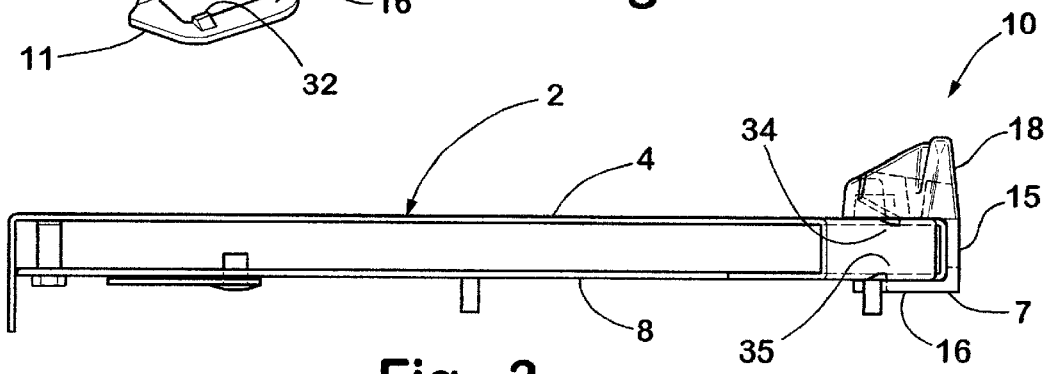
FIG. 3 is a side elevational view of the keyboard support tray and removable document support of FIG. 1
Figure 10:
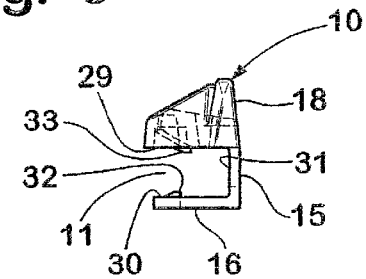
FIG. 10 is a side elevational view of the document support of FIG. 1.

With further reference to FIG. 10, clip 11 has a forwardly-opening U-shape formed by an upper surface 29, lower surface 30, and rear surface 31. A first barb 32 extends upwardly from lower surface 30, and a second barb 33 extends downwardly from upper surface 29. With further reference to FIG. 3, first barb 32 is received in an opening or indentation 35 in lower surface 8 of keyboard support tray 2, and the second barb 33 is received in an upper indentation or opening 34 in upper surface 4 of keyboard support tray 2 to retain the document support 10 on rear edge 7 of keyboard support tray 2. Document support 10 is made of a material having sufficient flexibility to permit flexing of clip 11 to an open position wherein barbs 32 and/or 33 are disengaged, thereby permitting manual removal and/or installation of document support 10.

The document support 10 of the present invention can be quickly and easily removed or installed on the keyboard support tray 2, as required by a particular user. The document support 10 positions a document 13 in an upright position wherein the document 13 can be easily viewed by a user of a computer keyboard or the like. Furthermore, the document support does not take up space on an associated worksurface, thereby freeing up the worksurface area for other desktop items.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A combination keyboard support tray and document support, comprising:

a keyboard support tray having a base adapted to secure said keyboard support tray to a worksurface, said keyboard support tray having an upper surface adapted to support a keyboard, and defining a perimeter having a front edge adapted to be positioned adjacent a user and a rear edge adapted to be positioned away from a user; and a document support having at least one clip securing said document support to said perimeter of said keyboard support tray, said document support including an upwardly-opening document support groove having a curved shape in plan view to retain a document in an upwardly-extending configuration wherein said document can be readily viewed by a user of the keyboard support tray.

2. The combination keyboard support tray and document support set forth in claim 1, wherein:

said clip has a U-shaped forwardly-opening portion receiving at least a portion of said rear edge of said keyboard support tray.

3. The combination keyboard support tray and document support set forth in claim 2, wherein:

said U-shaped portion of said clip is resilient and flexes outwardly to permit said document support to be snap-attached to said rear edge keyboard support tray.

4. The combination keyboard support tray and document support set forth in claim 3, wherein:

said clip includes a barb extending into said U-shaped portion and engaging said keyboard support tray to retain said document support on said keyboard support tray.

5. The combination keyboard support tray and document support set forth in claim 4, wherein:

said U-shaped portion of said clip defines opposed, generally parallel first and second inner surfaces;

said barb comprising a first barb extending from said first inner surface, and including:

a second barb extending inwardly from said second inner surface and cooperating with said first barb to retain said document support on said keyboard support tray.

6. The combination keyboard support tray and document support set forth in claim 5, wherein:

said document support groove has a U-shaped cross-sectional profile defining a base surface and opposed side surfaces, said base surface having a central portion with an opening therethrough that receives a lower edge of a document supported in said groove.

7. The combination keyboard support tray and document support set forth in claim 6, wherein:

a portion of said upper surface of said keyboard support tray is positioned below said opening through said central portion of said document support groove to support a lower edge of a document positioned in said groove; and said base surface defined by raised portions proximate opposite ends of said groove.

8. The combination keyboard support tray and document support set forth in claim 6, wherein:

said document support has an upwardly-extending wall adjacent said document support groove, said wall having a V-shaped notch therein adapted to receive and retain an electrical line of a computer mouse.

9. The combination keyboard support tray and document support set forth in claim 1, wherein:

said document support has a reduced height such that said keyboard support tray and document support may be attached to a conventional articulated arm support mechanism and positioned below a worksurface when in a stored position.

10. A combination keyboard support tray and document support, comprising:

a keyboard support tray having a rear edge adapted to be positioned away from a user, said keyboard support tray having a first connector; and a document support having an upwardly-opening document support groove having a curved shape in plan view, such that an edge portion of a document can be placed in said document support groove to support said document in an upwardly-extending configuration, said document support including a second connector releasably interconnecting said document support to said keyboard support tray and positioning said document support groove adjacent said rear edge such that a document supported in said groove extends upwardly above said keyboard support tray in a readily viewable position.

11. The combination keyboard support tray and document support set forth in claim 10, wherein:

said second connector comprises a clip having a U-shaped portion receiving at least a portion of said rear edge of said keyboard support tray.

12. The combination keyboard support tray and document support set forth in claim 11, wherein:

said U-shaped portion of said clip is resilient and flexes outwardly to permit said document support to be snap-attached to said keyboard support tray.

13. The combination keyboard support tray and document support set forth in claim 12, wherein:

said clip includes a barb extending into said U-shaped portion and engaging said keyboard support tray to retain said document support on said keyboard support tray.

14. The combination keyboard support tray and document support set forth in claim 13, wherein:

said U-shaped portion of said clip defines opposed, generally parallel first and second inner surfaces;

said barb comprising a first barb extending from said first inner surface, and including:

a second barb extending inwardly from said second inner surface and cooperating with said first barb to retain said document support on said keyboard support tray.

15. The combination keyboard support tray and document support set forth in claim 14, wherein:

said document support groove has a U-shaped cross-sectional profile defining a base surface and opposed side surfaces, said base surface having a central portion with an opening therethrough that receives a lower edge of a document supported in said document support groove.

16. The combination keyboard support tray and document support set forth in claim 15, wherein:

said document support has an upwardly-extending wall adjacent said document support groove, said wall having a V-shaped notch adapted to receive and retain an electrical line of a computer mouse.

17. A clip-on document support adapted for connection to an edge of a keyboard support tray, said document support comprising:

an attachment structure having a U-shaped portion configured to receive an edge portion of a keyboard support tray, said U-shaped portion defining first and second opposed side surfaces;

a first barb adapted to engage a keyboard support tray to retain said document support, said first barb extending inwardly from said first side surface;

a second barb extending inwardly from said second side surface;

an upwardly-opening document support groove having a curved shape in plan view to support a document in an upwardly-extending position; and wherein:

said U-shaped portion is flexible, such that said U-shaped portion of said attachment structure flexes outwardly to permit snap-attachment of said document support to a keyboard support tray.

18. The clip-on document support set forth in claim 17, wherein:

said barbs are wedge-shaped.

19. The clip-on document support set forth in claim 18, wherein:

said document support groove has a central portion with an opening therethrough adapted to receive an edge portion of a document.

20. The clip-on document support set forth in claim 19, wherein:

said document support has an upwardly-extending wall adjacent said groove, said wall having a V-shaped notch adapted to receive an electrical line of a computer mouse.

* * * * *